US008087658B2

(12) United States Patent
Ohtsuki

(10) Patent No.: US 8,087,658 B2
(45) Date of Patent: Jan. 3, 2012

(54) IMAGE FORMING DEVICE WITH OPEN/CLOSE COVER AND MANUAL PAPER FEEDING TRAY

(75) Inventor: Ryohei Ohtsuki, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 12/774,000

(22) Filed: May 5, 2010

(65) Prior Publication Data

US 2011/0001284 A1 Jan. 6, 2011

(30) Foreign Application Priority Data

Jul. 1, 2009 (JP) ..... 2009-156926

(51) Int. Cl.
*B65H 3/44* (2006.01)

(52) U.S. Cl. ..... 271/9.09; 271/162; 399/124; 399/392

(58) Field of Classification Search ..... 271/9.09, 271/273–274; 399/124, 392
See application file for complete search history.

(56) References Cited

U.S. PATENT DOCUMENTS 6,215,970 B1 * 4/2001 Yoshikawa et al. ..... 399/124
6,470,160 B1 * 10/2002 Murakami ..... 399/124
7,062,196 B2 * 6/2006 Nanno ..... 399/107
7,062,216 B2 * 6/2006 Nobe et al. ..... 399/391
7,203,448 B2 * 4/2007 Yokoi ..... 399/124
2006/0291931 A1 * 12/2006 Kobayashi ..... 399/392
2007/0248377 A1 * 10/2007 Palumbo et al. ..... 399/107
2008/0107446 A1 * 5/2008 Ohtsuki ..... 399/124

FOREIGN PATENT DOCUMENTS

JP 8-175689 A 7/1996
JP 2003-267593 A 9/2003
JP 2008-83442 A 4/2008

* cited by examiner

*Primary Examiner* — Jeremy R Severson
(74) *Attorney, Agent, or Firm* — Keating & Bennett, LLP

(57) ABSTRACT

A multifunction peripheral includes a main body, a jam access cover, and a manual paper feeding tray. The jam access cover can expose the interior of the main body by being rotated. The manual paper feeding tray is attached to the jam access cover so as to be rotatable with a tray rotation shaft at a position that is different from a jam access cover rotation shaft as a center. A projection is arranged on the manual paper feeding tray so as to contact with a recess on the main body side to regulate the rotation of the manual paper feeding tray when the jam access cover is opened. The manual paper feeding tray includes a distal end that is located a higher position than the jam access cover rotation shaft when the projection contacts with the recess.

4 Claims, 9 Drawing Sheets

IMAGE FORMING DEVICE WITH OPEN/CLOSE COVER AND MANUAL PAPER FEEDING TRAY

This application claims priority under 35 U.S.C. 119 to Japanese Patent Application No. 2009-156926, filed on Jul. 1, 2009, which application is hereby incorporated by reference in its entirety.

BACKGROUND OF THE INVENTION

1. Field of the Invention

The present invention relates to an image forming device, and specifically, to an open/close cover for exposing the interior of the main body and a manual paper feeding tray attached to the open/close cover.

2. Description of the Related Art

A configuration of attaching the open/close cover, which is rotatable with respect to the main body, to remove the paper that caused jamming (paper jam) in the interior of the main body in the image forming device is conventionally known. A manual paper feeding tray is sometimes attached to the open/close cover in such an image forming device. This type of image forming device is disclosed in Japanese Laid-Open Patent Publication No. 2008-83442.

Japanese Laid-Open Patent Publication No. 2008-83442 discloses an image forming device configured as below. In other words, the image forming device includes an open/close cover and a manual paper feeding tray. The open/close cover is configured so as to open/close at the side surface of an exterior cover with a lower end as a rotation supporting point. The manual paper feeding tray configures one portion of the open/close cover, and is configured so as to independently open/close with the rotation supporting point of the open/close cover as a center. The manual paper feeding tray and a manual paper feeding transportation path where paper fed from the manual paper feeding tray is transported are united as a paper transportation unit, which paper transportation unit is configured so as to be pulled out from the device main body. The manual paper feeding tray has the upper end and the side ends surrounded by the open/close cover while being opened with the open/close cover, where the surface facing the inner edge of the open/close cover at the upper end is formed to be horizontal or to define a falling gradient to the inner surface side.

The possible location of the manual paper feeding tray is limited in the configuration where the center of rotation of the open/close cover and the center of rotation of the manual paper feeding tray are on the same shaft line as in Japanese Laid-Open Patent Publication No. 2008-83442. From the standpoint of enhancing the degree of freedom in the arrangement of the manual paper feeding tray, a configuration in which the manual paper feeding tray is attached to the open/close cover with the center of rotation of the open/close cover and the center of rotation of the manual paper feeding tray being different, and the manual paper feeding tray is supported on the main body side at the usage position, has been considered.

In such a configuration, however, when the open/close cover is rotated with the manual paper feeding tray opened, the manual paper feeding tray separated from the usage position loses the support of the main body side and becomes freely rotatable. In such a freely rotatable state, the distal end side of the manual paper feeding tray rotates downward due to the weight thereof, and the position of the basal end side of the manual paper feeding tray moves upward by a great amount. When closing the open/close cover in such a state, the basal end side of the manual paper feeding tray that moved upward sometimes gets caught at the open/close cover.

SUMMARY OF THE INVENTION

In order to overcome the problems described above, preferred embodiments of the present invention provide a configuration enabling the open/close cover to be smoothly opened/closed even when using the manual paper feeding tray in the image forming device that is configured so that the rotation shaft of the open/close cover and the rotation shaft of the manual paper feeding tray are different.

According to a preferred embodiment of the present invention, an image forming device includes a main body, an open/close cover, a manual paper feeding tray, a main body side contacting portion, and a tray side contacting portion. The main body includes an image forming unit. The open/close cover can expose an interior of the main body by being rotated. The manual paper feeding tray is attached to the open/close cover so as to be rotatable with a second rotation shaft that is different from a first rotation shaft, which is a rotation shaft of the open/close cover as a center. The main body side contacting portion is arranged on the main body side. The tray side contacting portion is arranged on the manual paper feeding tray. The tray side contacting portion regulates the rotation of the manual paper feeding tray by contacting with the main body side contacting portion with the open/close cover opened.

Thus, the excessive rotation can be prevented by the tray side contacting portion and the main body side contacting portion even if the open/close cover is opened with the manual paper feeding tray opened, the second rotation shaft of the manual paper feeding tray moves with the movement of the open/close cover, and the manual paper feeding tray is in a freely rotatable state. Therefore, the excessively rotated manual paper feeding tray is prevented from interfering with other members and preventing the open/close cover from being closed. Since the configuration of regulating the rotation by having the tray side contacting portion contact with the main body side contacting portion is adopted, the excessive rotation of the manual paper feeding tray can be reliably prevented regardless of the position of the open/close cover. The degree of freedom in the arrangement of the manual paper feeding tray can be enhanced since the paper feed tray is attached to the open/close cover with the shaft lines of the first rotation shaft and the second rotation shaft being different.

In a preferred embodiment of the image forming device, the tray side contacting portion preferably regulates the rotation of the manual paper feeding tray at a position such that a distal end of the manual paper feeding tray becomes higher than the second rotation shaft.

A sheet of recording paper is thus prevented from dropping from the distal end side of the manual paper feeding tray even if the open/close cover is opened with the recording paper set in the manual paper feeding tray and the second rotation shaft of the manual paper feeding tray moves.

In a preferred embodiment of the image forming device, a positioning unit, arranged on the main body, to secure the usage position when using the manual paper feeding tray is preferably included.

The manual paper feeding tray thus can be held at a stable and accurate position by the positioning unit, and the operation of sending the recording paper set in the manual paper feeding tray to the interior of the main body can be smoothly carried out.

In a preferred embodiment of the image forming device, a rotation regulating mechanism including the main body side contacting portion and the tray side contacting portion preferably includes by a projection and a recess corresponding to the projection.

A simple configuration capable of reliably regulating the rotation of the manual paper feeding tray thus can be realized.

In a preferred embodiment of the image forming device, the tray side contacting portion preferably does not contact with the main body side contacting portion if the manual paper feeding tray is positioned at the usage position.

Thus, the usage position of the manual paper feeding tray can be more accurately positioned without the tray side contacting portion and the main body side contacting portion getting in the way.

In a preferred embodiment of the image forming device, a plurality of the tray side contacting portions are preferably arranged side by side in a width direction of the manual paper feeding tray.

Thus, the impact that occurs when the tray side contacting portion contacts with the main body side contacting portion can be dispersed, and the manual paper feeding tray can be stably held at the relevant position (contact positions) after contacting with each other.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
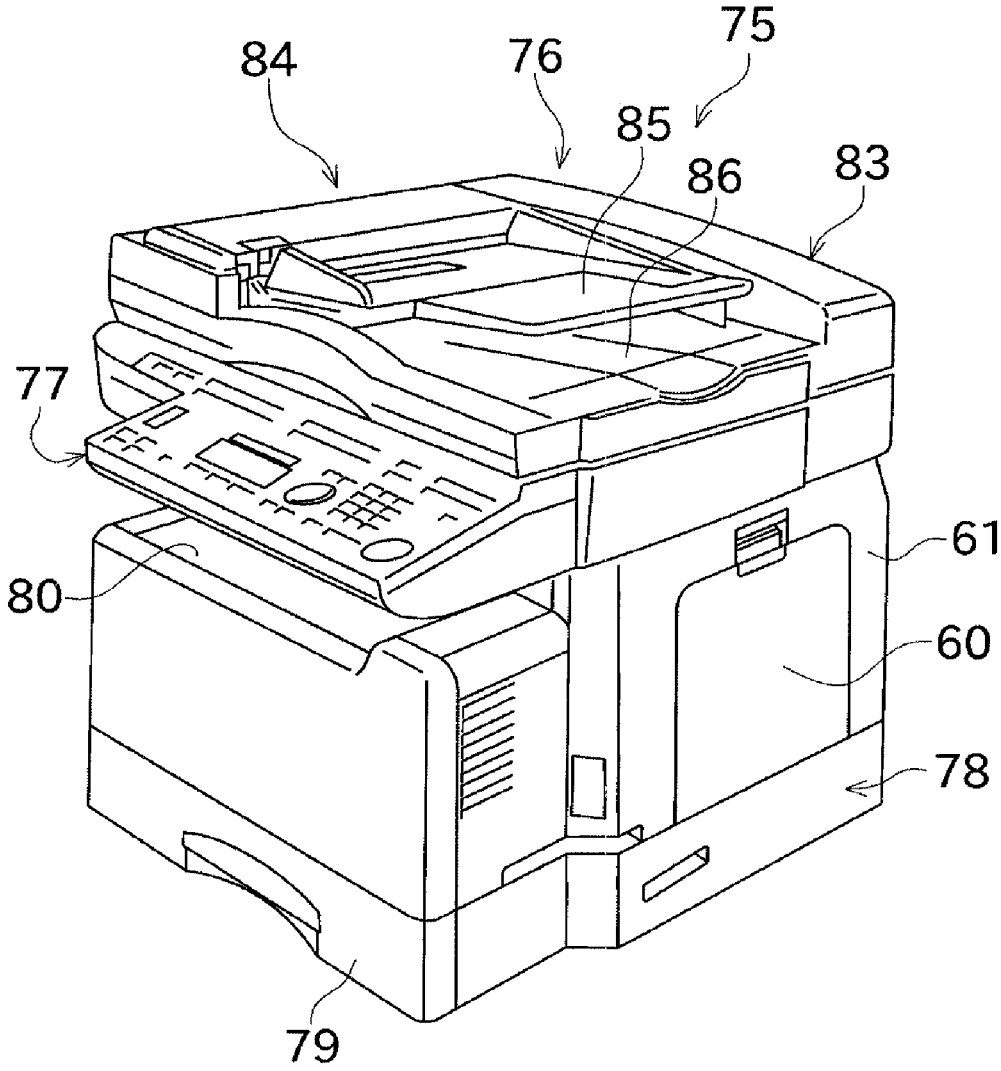
FIG. 1 is a perspective view of an outer appearance of a copy-facsimile multifunction peripheral according to one preferred embodiment of the present invention.
Figure 2:
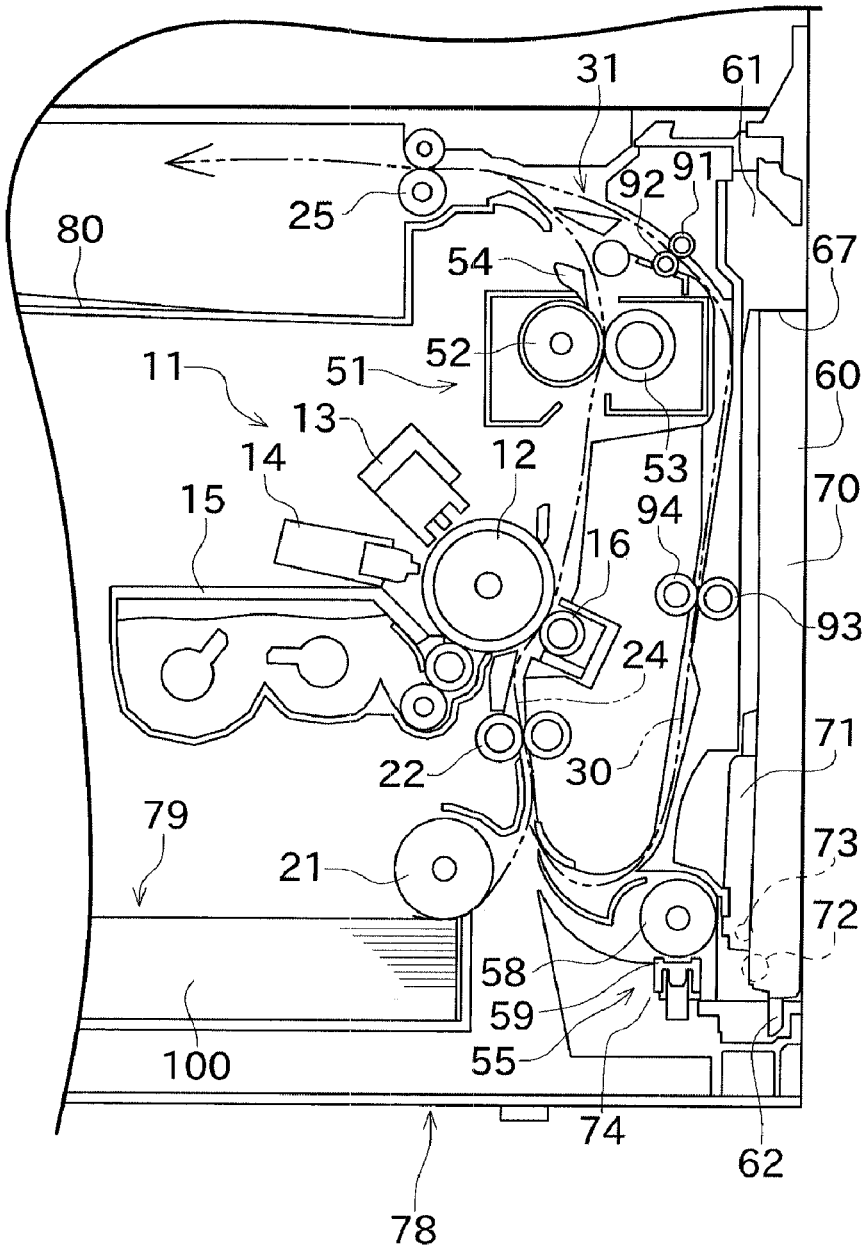
FIG. 2 is a cross-sectional view schematically illustrating one portion of the internal configuration of a main body.

Preferred embodiments of the present invention will now be described. FIG. 1 is a perspective view of an outer appearance of a copy-facsimile multifunction peripheral 75 serving as an image forming device according to one preferred embodiment of the present invention. FIG. 2 is a cross-sectional view schematically illustrating one portion of the internal configuration of a main body 78 of the multifunction peripheral 75. In the following description, the direction orthogonal to the direction of transporting a sheet of paper 100 (transporting direction) is sometimes referred to as a width direction.

As illustrated in FIG. 1, the copy facsimile multifunction peripheral 75 includes an image reading unit 76, an operation panel 77, the main body 78, and a paper feed cassette 79. The configuration of each unit will be described below.

The image reading unit 76 is provided to read documents, and includes a scanner unit (not illustrated) serving as a reading unit, a platen cover 83, an automatic document feeder (ADF) 84, a document tray 85, and a discharge tray 86. The scanner unit is arranged at the upper portion in the main body 78, and is configured as a reading unit of a reduction optical system including a light source, a reflection mirror, a light collecting lens, a charge coupled device (CCD), and the like. The light source, the reflection mirror, and the like of the scanner unit are configured to be appropriately movable, so that the document on a platen glass arranged on the upper surface of the main body 78 can be scanned and read. The platen cover 83 is arranged on the upper side of the main body 78, and enables the scanner unit to read the document while pressing down and fixing the document on the platen glass by the platen cover 83 when reading the document on the platen glass.

The ADF 84 is arranged on the platen cover 83. The document tray 85 is attached below the ADF 84, and the discharge tray 86 is arranged at the lower side of the document tray 85. The document set on the document tray 85 is transported along the document transportation path formed inside the ADF 84, and discharged to the discharge tray 86 after passing the document reading position. When reading the document using the ADF 84, the multifunction peripheral 75 moves the light source, the reflection mirror, and the like up to the document reading position of the ADF 84, and brings them to rest in such a state. The document transported in the document transportation path by the ADF 84 is scanned at the document reading position.

Therefore, the image reading unit 76 is configured to function as a flat bed scanner and an auto document feeder scanner. An electrical signal containing image information read by the scanner unit is transmitted to and printed at an image forming unit 11, to be described later, after being subjected to an appropriate conversion process, or transmitted to other facsimile devices through a communication line.

The operation panel 77 is provided for the user to instruct the number of copies, a facsimile transmission destination, and the like to the multifunction peripheral 75.

The main body 78 includes a transmitter/receiver, and the like (not illustrated) for transmitting image data through the communication line to carry out facsimile communication. As illustrated in FIG. 2, the main body 78 includes the image forming unit 11, a fixing device 51, and a jam access cover (open/close cover) 61.

The image forming unit 11 and the fixing device 51 can print the image data read by the image reading unit 76, or the image data received by the transmitter/receiver through the facsimile communication on the paper 100. The jam access cover 61 exposes one portion of the interior of the main body 78 to remove the paper 100 that caused jamming. The jam access cover 61 is turnably (rotatably) attached to the main body 78 through a jam access cover rotation shaft (first rotation shaft) 72. As illustrated in FIG. 2, the jam access cover 61 defines one portion of the wall surface of the main body 78 in the closed state. The details on the configuration of the main body 78 will be described later.

As illustrated in FIG. 2, the paper feed cassette 79 is arranged at the lower portion of the main body 78, and is configured so as to sequentially feed the paper 100 serving as a recording medium to the image forming unit 11. The paper feed cassette 79 is configured so as to be pulled out towards the front surface side of the device (near side in the plane of drawing in FIG. 2), so that the paper feed cassette 79 can be pulled out to refill the paper 100.

The interior configuration of the main body 78 will now be described. As illustrated in FIG. 2, a first transportation path 24 for transporting the paper 100 from the paper feed cassette 79 to a discharge tray 80 is provided inside the main body 78. The first transportation path 24 is configured to extend upward from one end side of the paper feed cassette 79 to the image forming unit 11 while partially curving, pass the fixing device 51 on the further upper side, and then curve in the horizontal direction to the discharge tray 80.

A paper feed roller 21 is arranged in the vicinity of and on the upper side of the paper feed cassette 79. The paper feed roller 21 is configured to contact the paper 100 at the uppermost layer stacked in the paper feed cassette 79. When the paper feed roller 21 is driven in this state, the paper 100 at the uppermost layer separates from the paper feed roller 21 by a separation pad (not illustrated), and is fed into the first transportation path 24.

A transportation roller 22 is arranged immediately on the downstream side of the paper feed roller 21 in the first transportation path 24. The transportation roller 22 is driven while nipping the paper 100 with the roller (driven roller) arranged facing thereto, thereby transporting the paper 100 to the image forming unit 11 on the downstream side. The transportation roller 22 is arranged on the main body 78 side, and the driven roller is arranged on the jam access cover 61 side.

As illustrated in FIG. 2, the image forming unit 11 preferably includes a charger 13, an LED head 14, a developing unit 15, and a transfer roller 16 arranged at the periphery of a photoconductive drum 12. The image forming unit 11 also includes a toner replenishing portion (not illustrated) for supplying toner to the developing unit 15.

The photoconductive drum 12 has a photoconduction film made of an organic photosensitive member formed thereon, and is configured to be rotatably driven (counterclockwise in FIG. 2) by an electric motor (not illustrated). The charger 13 is configured to a non-contact corona charging type, so that the surface of the photoconductive drum 12 is uniformly charged by the charger 13, for example, to negative. The photoconductive drum 12 is attached to the main body 78 side.

The LED head 14 serving as an exposure device is arranged on the downstream side than the charger 13 (downstream side in the rotation direction of the photoconductive drum 12, same in the description of the developing unit 15 and the transfer roller 16), and has a configuration in which a number of light emitting diodes (LED) are lined up in the paper width direction. The LED head 14 selectively emits light in correspondence to the image data read by the image reading unit 76 or the image data of the facsimile document received through a telephone line. As a result, the surface of the photoconductive drum 12 is selectively exposed, and the charged energy of the exposed portion disappears thereby forming an electrostatic latent image.

The developing unit 15 is arranged on the downstream side of the LED head 14. The developing unit 15 includes a toner container for accommodating the toner, and a stirring blade rotatably driven inside the toner container to stir the toner. The developing unit 15 also includes a supply roller arranged inside the toner container, a development roller arranged in contact with the supply roller, and a regulation blade arranged to contact with the outer circumferential surface of the development roller. In such a configuration, the supply roller and the development roller are rotatably driven to respectively rub the circumferential surface in the opposite direction. The distal end of the regulation blade rubs the circumferential surface of the rotatably driven development roller. As a result, the toner in the toner container is triboelectrically charged, and attaches to the surface of the development roller by potential difference. The toner at the surface of the development roller has the attachment thickness adjusted by the regulation blade so as to be even, and sent towards the photoconductive drum 12 by the rotation of the development roller. Thereafter, the toner at the surface of the development roller selectively moves to the surface of the photoconductive drum 12 only at the portion corresponding to the exposed portion by the LED head 14 of the photoconductive drum 12 at the proximate portion of the photoconductive drum 12 and the development roller. A toner image consequently forms on the surface of the photoconductive drum 12.

The transfer roller 16 is arranged on the downstream side of the developing unit 15, and is arranged on the opposite side from the photoconductive drum 12 with the first transportation path 24 in between. A predetermined voltage from the power is applied to the transfer roller 16. Therefore, the toner image formed on the surface of the photoconductive drum 12 moves to approach the transfer roller 16 side by the rotation of the photoconductive drum 12, and is transferred to the paper 100 by the electric field attraction force. The paper 100 transferred with the toner image is sent to the fixing device 51 on the downstream side of the first transportation path 24 by the rotation of the photoconductive drum 12. The transfer roller 16 is attached to the jam access cover 61 side.

The fixing device 51 includes a rotatably driven heat roller 52, and a press roller 53 arranged facing the heat roller 52. The press roller 53 is pressed against the heat roller 52 by a bias spring. The heat roller 52 includes a heat generating body such as a halogen lamp, so that the surface of the heat roller 52 can be uniformly heated by flowing current to the heat generating body. The fixing device 51 of the present preferred embodiment is removably attached to the main body 78 side as one unit. The attachment/detachment task of the unit including the fixing device 51 is carried out with the jam access cover 61 turned and the interior of the main body 78 exposed.

In this configuration, when the paper 100 passes between the heat roller 52 and the press roller 53, the toner of the toner image fuses and fixes to the paper 100 by the heat of the high temperature heat roller 52 and the pressure of the press roller 53. The fixing device 51 includes a separating claw 54 arranged to prevent the paper 100 from being wrapped around the periphery while being attached to the heat roller 52.

As illustrated in FIG. 2, a paper discharge roller 25 is arranged on the downstream side than the fixing device 51. The paper 100 fed from the fixing device 51 is nipped between the paper discharge roller 25 and the driven roller arranged facing thereto, and is discharged onto the discharge tray 80. The paper discharge roller 25 is configured to be able to switch the rotating direction, where the rotating direction is switched at an appropriate timing if duplex printing is specified with the operation panel 77, and the like.

The multifunction peripheral 75 of the present preferred embodiment preferably includes a second transportation path 30 and a path switching mechanism 31 to realize duplex printing. The second transportation path 30 has one end connected to the first transportation path 24 on the downstream side of the fixing device 51, and the other end connected to the first transportation path 24 at the area on the downstream side than the paper feed roller 21 and on the upstream side than the image forming unit 11.

As illustrated in FIG. 2, the second transportation path 30 defines a substantially U-turn shaped path in combination with one part of the second transportation path 24. The turn-shaped path is configured to reverse the paper 100 that once passed the image forming unit 11 and guide the same to the image forming unit 11.

The path switching mechanism 31 is arranged near a connecting portion of the first transportation path 24 and the second transportation path 30 on the downstream side of the fixing device 51. The path switching mechanism 31 includes a claw member arranged to switch the path to the first transportation path 24 and the second transportation path 30. A drive roller 91 for transporting the paper 100 and an opposing roller 92 serving as a press roller facing the drive roller 91 are arranged on the second transportation path 30 and in the vicinity of the path switching mechanism 31. The drive roller 91 is arranged on the jam access cover 61 side, and receives the drive force transmitted from the main body 78 side through a transmitting mechanism (not illustrated). The opposing roller 92 is supported on the main body 78 side. A drive roller 93 for transporting the paper 100, and an opposing roller 94 serving as a press roller facing the drive roller 93 are arranged on the downstream side (lower side) of the second transportation path 30 of the drive roller 91 and the opposing roller 92. The drive roller 93 and the opposing roller 94 are both supported on the jam access cover 61 side, and the drive force is transmitted from the transmitting mechanism (drive roller 91) to the drive roller 93 through a belt (not illustrated).

If duplex printing is specified with the operation panel 77 and the like in this configuration, an image is first formed on one side of the paper 100 by the image forming unit 11 and the fixing device 51, similar to a case of printing on one side. The paper 100 formed with the image is transported to the paper discharge roller 25. As described above, since the rotating direction of the paper discharge roller 25 is switched at an appropriate timing, the paper 100 is transported in the first transportation path 24 in the opposite direction by the reverse drive of the paper discharge roller 25. The switch-back transported paper 100 is sent not to the fixing device 51 side but to the second transportation 30 side as the path switching mechanism 31 switches the path with the claw member. The paper 100 sent to the second transportation path 30 is reversed and again sent to the image forming unit 11, so that the image is formed on the other side (surface not formed with the image). Thereafter, the paper 100 is discharged to the discharge tray 80 by the paper discharge roller 25, the rotating direction of which is now switched to the forward direction.

The multifunction peripheral 75 of the present preferred embodiment includes a manual paper feeding tray 60 serving as a sheet supply tray attached to the main body 78 through the jam access cover 61, and is configured such that the paper 100 can be manually supplied from the manual paper feeding tray 60 to the main body 78.

Figure 3:
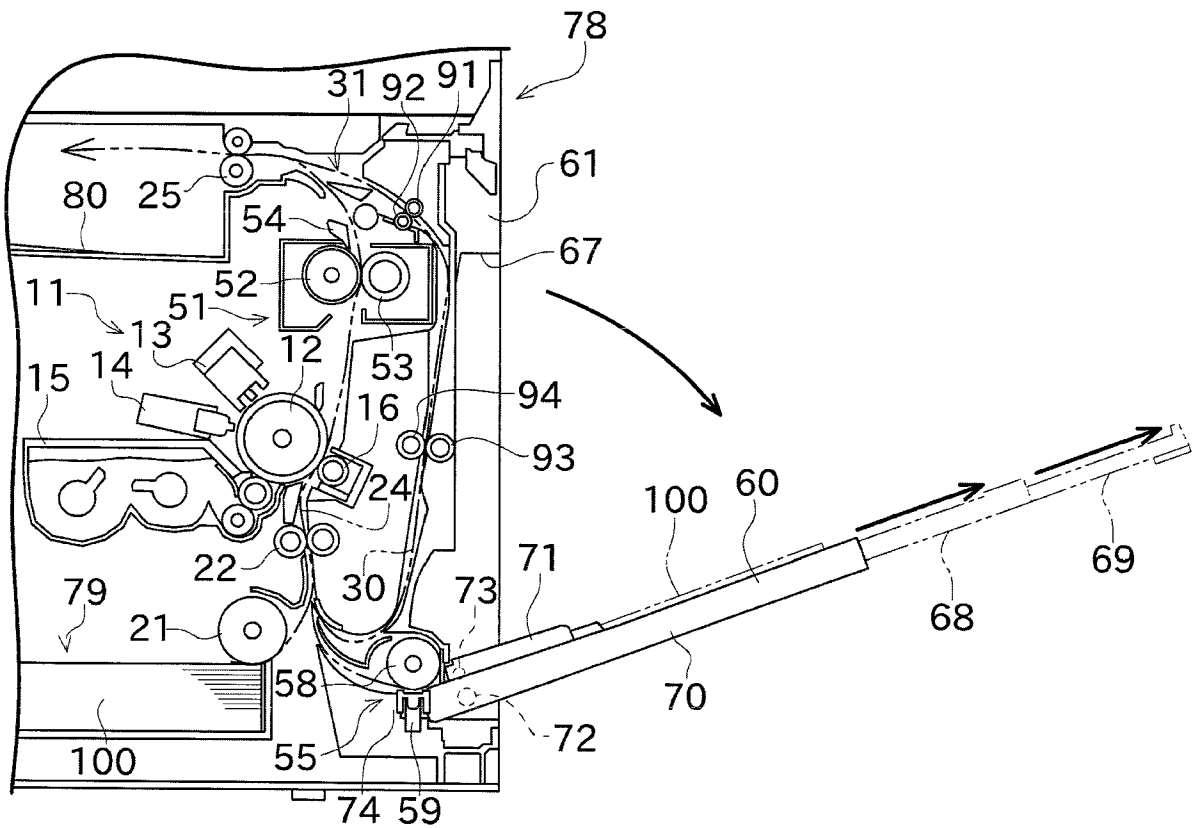
FIG. 3 is a cross-sectional view illustrating a state of the main body when a manual paper feeding tray is moved to the usage position.
Figure 4:
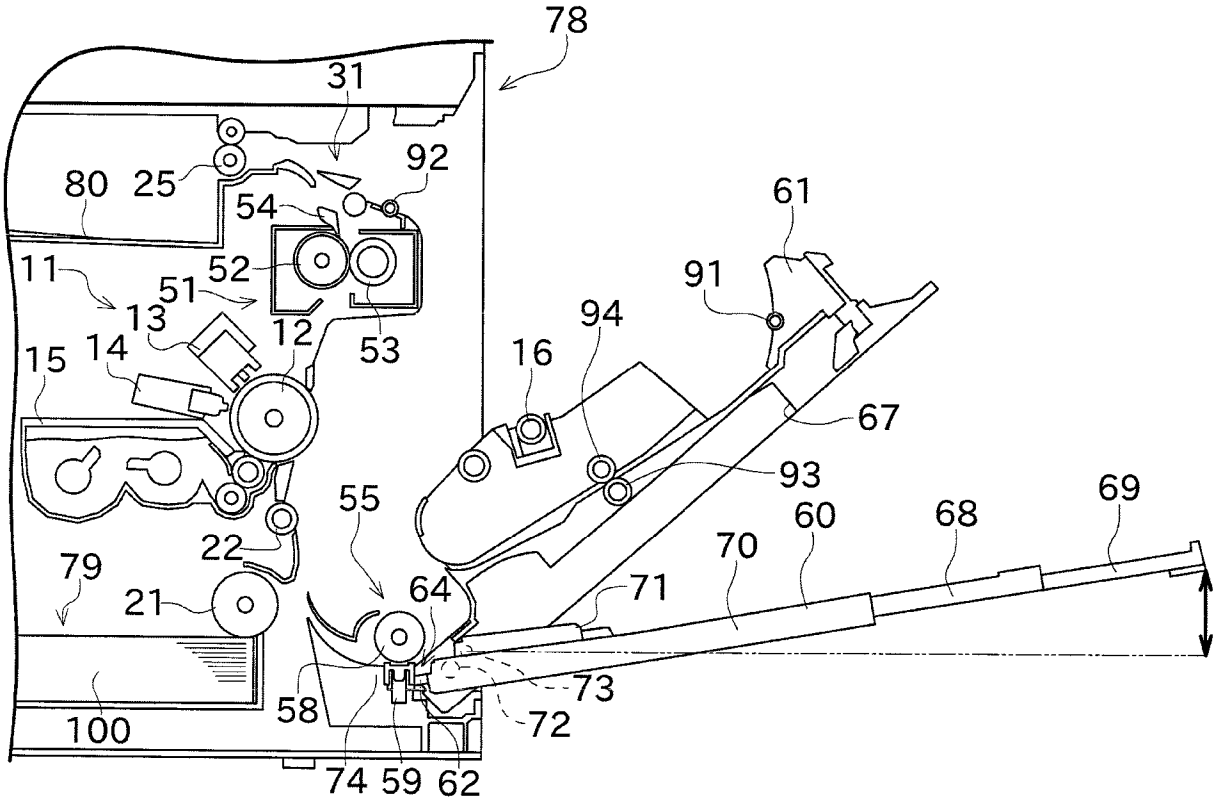
FIG. 4 is a cross-sectional view illustrating a state of the main body when a jam access cover is moved to the exposed position.
Figure 5:
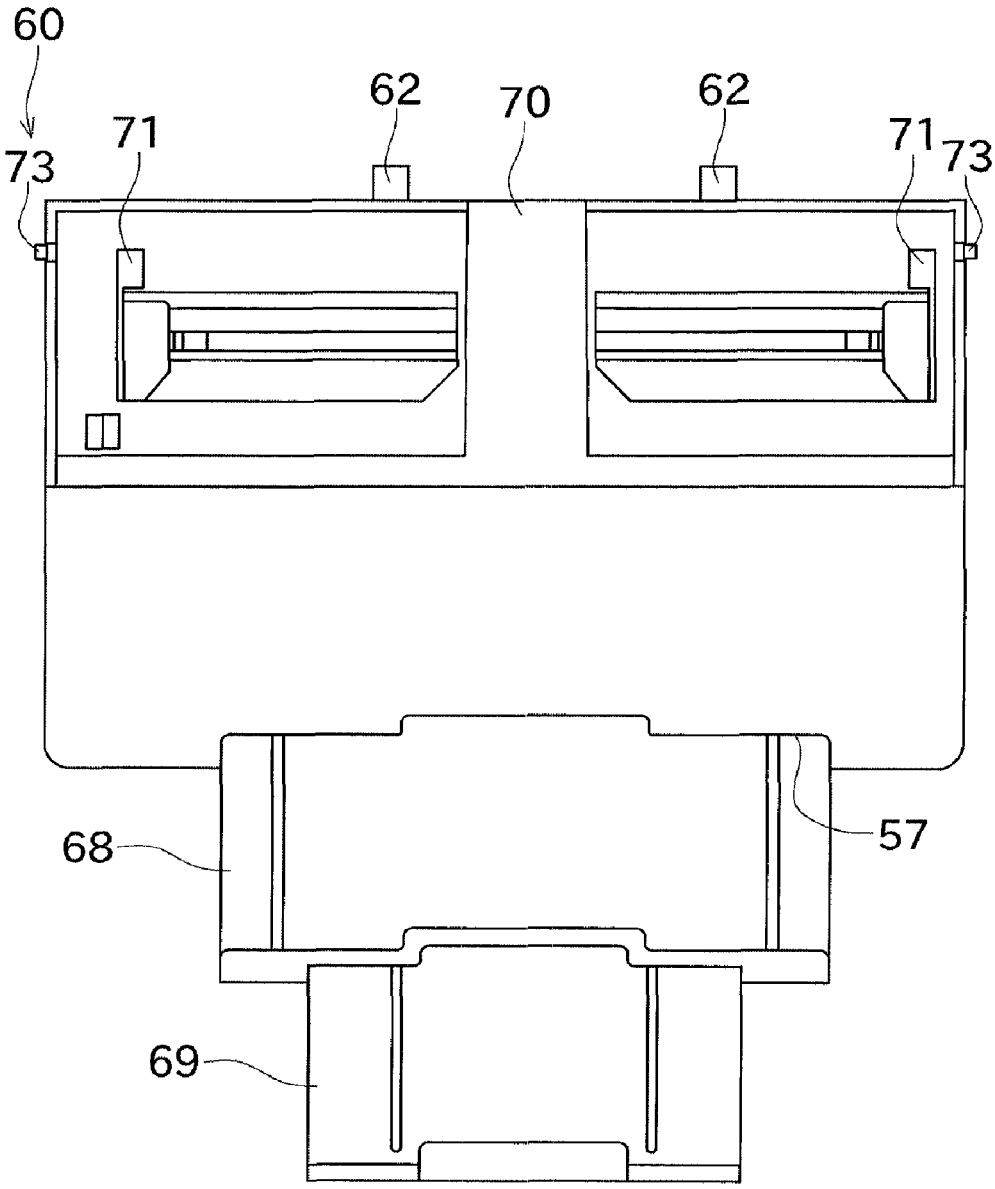
FIG. 5 is a plan view of the manual paper feeding tray.
Figure 6:
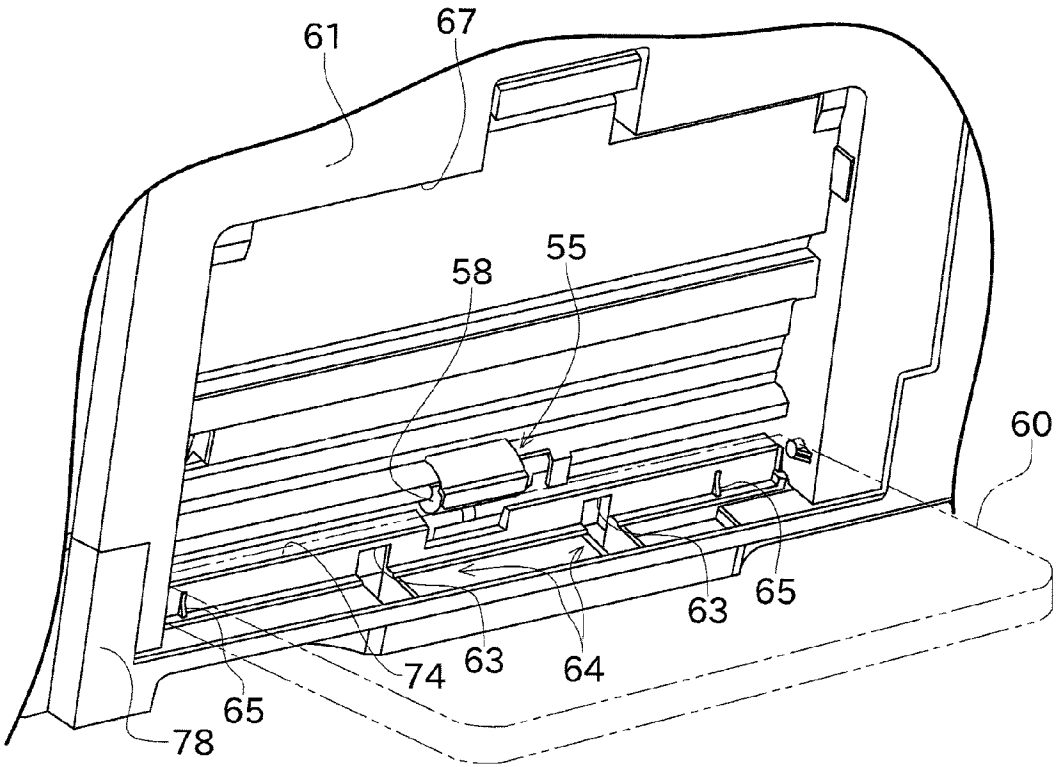
FIG. 6 is a perspective view illustrating a state of a housing unit of the jam access cover.
Figure 7:
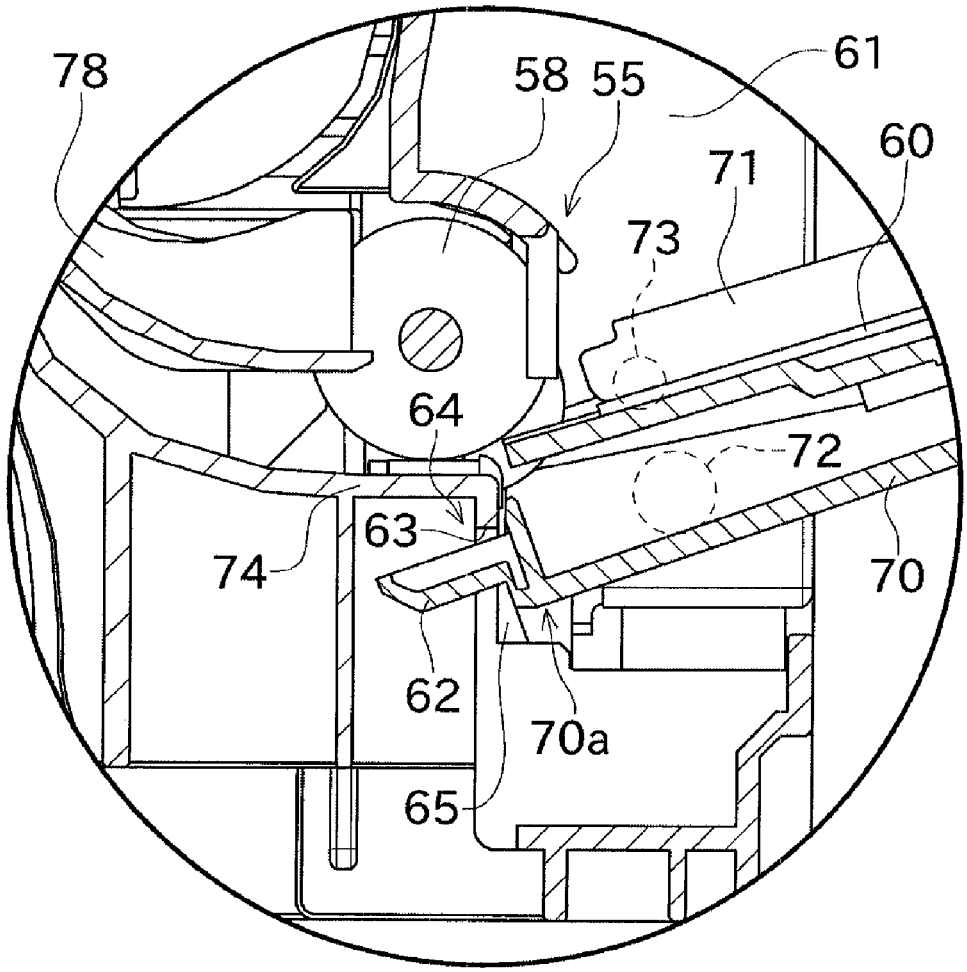
FIG. 7 is an enlarged cross-sectional view illustrating a state near a manual paper feeding roller when the manual paper feeding tray is at the usage position.
Figure 8:
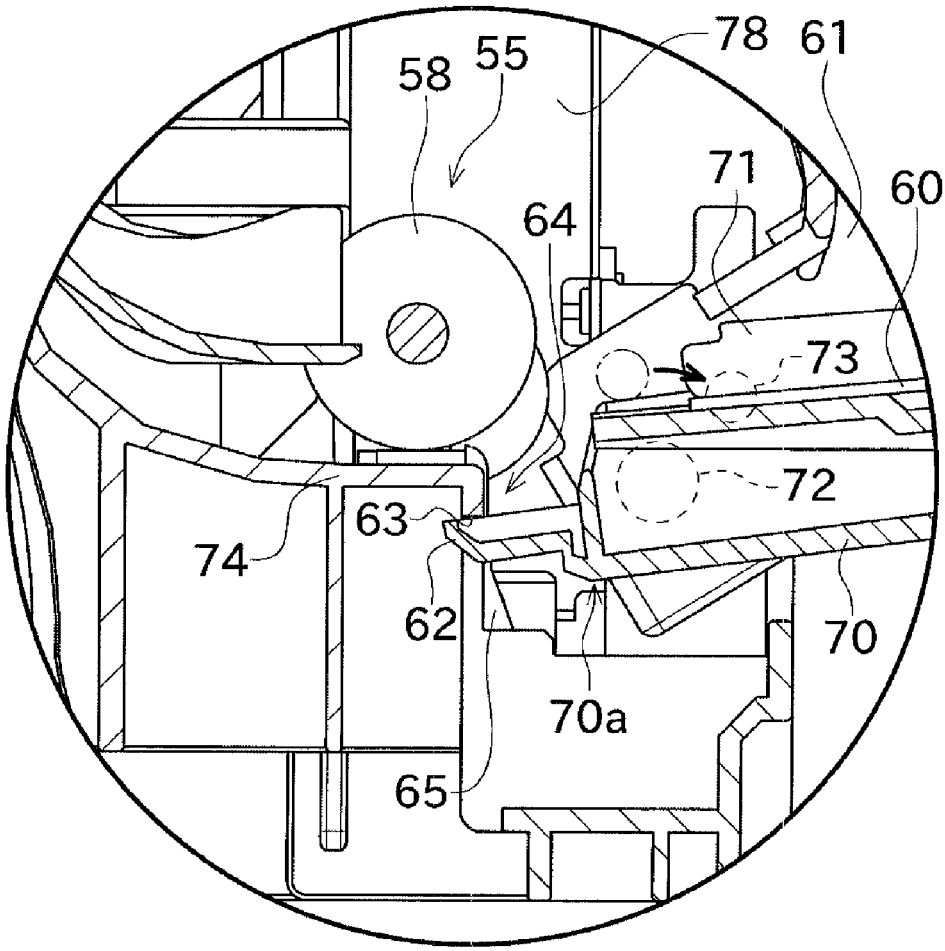
FIG. 8 is an enlarged cross-sectional view illustrating a state near the manual paper feeding roller when the rotation of the manual paper feeding tray is regulated by a projection and a recess.

The configuration of the manual paper feeding tray 60 and the jam access cover 61 will be described with reference to FIG. 3 to FIG. 8. FIG. 3 is a cross-sectional view illustrating a state of the main body 78 when the manual paper feeding tray 60 is moved to the usage position. FIG. 4 is a cross-sectional view illustrating a state of the main body 78 when the jam access cover 61 is moved to the exposed position. FIG. 5 is a plan view of the manual paper feeding tray 60. FIG. 6 is a perspective view illustrating a state of a housing unit 67 of the jam access cover 61. FIG. 7 is an enlarged cross-sectional view illustrating a state near a manual paper feeding roller 58 when the manual paper feeding tray 60 is at the usage position. FIG. 8 is an enlarged cross-sectional view illustrating a state near the manual paper feeding roller 58 when the rotation of the manual paper feeding tray 60 is regulated by a projection 62 and a recess 63.

As illustrated in FIG. 3 and FIG. 5, the manual paper feeding tray 60 includes a tray rotation shaft 73 for rotating independently with respect to the jam access cover 61. The tray rotation shafts 73 project out from both side surfaces of a tray main body 70, and are positioned at the portion on the downstream side in the transporting direction of the tray main body 70. The manual paper feeding tray 60 is attached to the jam access cover 61 by way of the tray rotation shafts 73. As illustrated in FIG. 2, the multifunction peripheral 75 of the present preferred embodiment is configured such that the center of rotation (tray rotation shaft 73) of the manual paper feeding tray 60 is positioned near the lower portion (end) of the jam access cover 61 when the manual paper feeding tray 60 is functioning as one portion of the wall surface of the main body 78. The detailed configuration of the manual paper feeding tray 60 will be described later.

The multifunction peripheral 75 of the present preferred embodiment is configured so that the center of rotation of the manual paper feeding tray 60 and the center of rotation of the jam access cover 61 are different. In other words, the shaft line of the tray rotation shaft 73 of the manual paper feeding tray 60 is set at a position shifted from the shaft line of a jam access cover rotation shaft 72 of the jam access cover 61. More specifically, the tray rotation shaft 73 is on the upper side of the jam access cover rotation shaft 72 and is positioned on the far side (left side in FIG. 2) of the main body 78 than the jam access cover rotation shaft 72 when the manual paper feeding tray 60 and the jam access cover 61 are in the standing state as illustrated in FIG. 2.

As illustrated in FIG. 3 and FIG. 6, the recess-shaped housing unit 67 is provided in the jam access cover 61, and the manual paper feeding tray 60 can be housed in the housing unit 67. The user can house the manual paper feeding tray 60 in the housing unit 67 when not using the manual paper feeding tray 60 (when feeding the paper 100 from the paper feed cassette 79 to the image forming unit 11, and the like). When using the manual paper feeding tray 60, the manual paper feeding tray 60 is pulled down in the direction shown with an arrow in FIG. 3 from the state illustrated in FIG. 2 and turned up to the position where the paper 100 can be set, whereby a state illustrated in FIG. 3 is obtained. In the following description, the position (position of FIG. 2) where the manual paper feeding tray 60 is housed in the housing unit 67 is called the housing position, and the position (position of FIG. 3) of the manual paper feeding tray 60 when feeding the paper 100 into the main body 78 using the manual paper feeding tray 60 is called the usage position.

The main body 78 includes a feeding unit 55 for feeding the paper 100 on the manual paper feeding tray 60 into the main body 78. The feeding unit 55 is arranged on the downstream side in the transporting direction of the manual paper tray 60 at the usage position, and includes the manual paper feeding roller 58 and a manual paper feeding separation pad 59. The feeding unit 55 is arranged above the contacting portion on the main body side.

As illustrated in FIG. 3, the manual paper feeding roller 58 is arranged at the lower portion of the main body 78 near the tray rotation shaft 73 of the manual paper feeding tray 60. The manual paper feeding separation pad 59 is arranged below the manual paper feeding roller 58. The manual paper feeding roller 58 feeds the paper 100 set in the manual paper feeding tray 60 to the first transportation path 24, and is configured to contact with the paper 100 at the uppermost layer stacked on the manual paper feeding tray 60. When the manual paper feeding tray roller 58 is driven, the paper 100 at the uppermost layer is separated from the papers 100 stacked on the manual paper feeding tray 60, so that the paper 100 is fed to the image forming unit 11 in the main body 78 one sheet at a time.

The multifunction peripheral 75 of the present preferred embodiment is configured such that the height of the portion the feeding unit 55 feeds the paper 100 (portion the manual paper feeding roller 58 and the manual paper feeding separation pad 59 nip the paper 100) is positioned at a portion lower than the tray rotation shaft 73.

A manual paper feeding guide 74 is arranged near the manual paper feeding separation pad 59. The manual paper feeding guide 74 guides the paper 100 from the feeding unit 55 to the first transportation path 24 from the lower portion. The paper 100 fed into the main body 78 by the manual paper feeding roller 58 is fed to the first transportation path 24 while being guided by the manual paper feeding guide 74. A merging portion where the paper 100 fed from the manual paper feeding tray 60 merges the first transportation path 24 is provided between the paper feed roller 21 and the transportation roller 22 of the first transportation path 24.

The detailed configuration of the manual paper feeding tray 60 will now be described. The manual paper feeding tray 60 of the present preferred embodiment preferably includes the tray main body 70, a manual paper feeding side guide 71, a first extending tray 68, a second extending tray 69, and two projections 62. As described above, the tray rotation shafts 73 serving as a connecting portion for connecting the tray main body 70 to the jam access cover 61 (main body 78) are arranged at the side surfaces of the tray main body 70. The projection 62 functions as a tray side contacting portion configuring one portion of a rotation regulating mechanism 64, to be described later, and thus the details on the projection 62 will be described in the section of the rotation regulating mechanism 64.

The tray main body 70 preferably has a flat plate shape that is long in the width direction, where a housing space (not illustrated) for housing the first extending tray 68, to be described later, is interiorly formed. The upper surface of the tray main body 70 functions as a placement surface (setting surface) for setting the paper 100.

The tray main body 70 is configured such that the distal end side (upstream side in transporting direction) is supported at the position on the upper side than the tray rotation shaft 73 at the usage position of the manual paper feeding tray 60. Therefore, when actually using the paper feeding tray 60, the upper surface (the placement surface) of the manual paper feeding tray 60 becomes an inclined surface, and force towards the downstream side in the transporting direction due to its own weight is applied on the paper 100 placed on the placement surface. At the usage position of the manual paper feeding tray 60, the height of the distal end of the tray main body 70 (placement surface) is higher than the height of the portion the feeding unit 55 feeds the paper 100, and thus the paper 100 is taken into the feeding unit 55 from the obliquely upper side.

The manual paper feeding side guides 71 guide the side surfaces of the paper 100, and are attached to the downstream side in the transporting direction of the upper surface of the tray main body 70. Two manual paper feeding side guides 71 define a set, and are arranged to sandwich the paper 100 in the width direction. The manual paper feeding side guide 71 of the present preferred embodiment is configured to slidably move in the width direction, so that the position of the manual paper feeding side guides 71 can be adjusted in accordance with the size of the paper 100.

The first extending tray 68 and the second extending tray 69 are both provided to extend the placement surface of the paper 100 in the upstream side in the transporting direction. The first extending tray 68 is configured to be slidable with respect to the main body of the manual paper feeding tray 60, and can be housed in the housing space of the tray main body 70. The second extending tray 69 is configured to slidably move with respect to the first extending tray 68, and can be housed inside the first extending tray 68. When housing the manual paper feeding tray 60, the manual paper feeding tray 60 is turned to the housing position with the second extending tray 69 housed in the first extending tray 68, and the first extending tray 68 housed in the tray main body 70.

With this configuration, if the size of the paper 100 to set on the manual paper feeding tray 60 is large, the first extending tray 68 and the second extending tray 69 are pulled out to the position of chain line in FIG. 3 to extend the placement surface, so that the paper feeding task of the paper 100 of large size can be appropriately carried out. Only the first extending tray 68 may be pulled out from the tray main body 70. The manual paper feeding tray 60 of the present preferred embodiment thus can extend the placement surface of the paper 100 in two stages.

A cutout 57 is formed on the upstream side in the transporting direction of the upper surface of the tray main body 70. As illustrated in the plan view of FIG. 5, the cutout 57 is formed at the central portion in the width direction, and one portion of the first extending tray 68 is exposed from the cutout 57. When pulling out the first extending tray 68 housed in the tray main body 70, the user can easily slidably move the first extending tray 68 to the usage position by gripping the portion of the first extending tray 68 exposed from the cutout 57 and pulling out the relevant portion towards the upstream side in the transporting direction.

The jam access cover 61 will be described below. As described above, the jam access cover 61 includes the jam access cover rotation shafts (first rotation shaft) 72. The jam access cover 61 is attached to one side of the side surface of the main body 78 so that the jam access cover rotation shafts 72 are positioned at the lower portion of the main body 78. In the following description, the position of the jam access cover 61 when defining one portion of the side surface of the main body 78 (positions of FIGS. 2 and 3) is sometimes referred to as a closed position. The position of the jam access cover 61 when exposing one portion of the interior of the main body 78 (position of FIG. 4) is sometimes referred to as an exposed position.

In the multifunction peripheral 75 of the present preferred embodiment, the jam access cover 61 is moved to the exposed position to expose the interior of the main body 78 when the paper 100 jams in the first transportation path 24 or the second transportation path 30 for some reason (when jamming occurred). More specifically, the jam access cover 61 at the closed position is pulled down in the direction of separating from the main body 78 (turned downward). The contact between the transportation roller 22 and the driven roller, and the contact between the photoconductive drum 12 and the transfer roller 16 are thereby released, and portions of the first transportation path 24 and the second transportation path 30 are exposed to the outside, as illustrated in FIG. 4.

The multifunction peripheral 75 of the present preferred embodiment includes the rotation regulating mechanism 64 arranged to prevent the manual paper feeding tray 60 from rotating in excess when the jam access cover 61 is turned to the exposed position. The rotation regulating mechanism 64 includes a recess 63 formed at two areas on the main body 78 side, and two projections 62 arranged on the manual paper feeding tray 60 side.

As illustrated in FIG. 5 and FIG. 7, the two projections 62 are arranged to project out straightly from the end surface on the downstream side in the transporting direction of the manual paper feeding tray 60, and arranged in line in the width direction. The projection 62 of the present preferred embodiment is configured so that the distal end of the manual paper feeding tray 60 does not contact with the main body 78 side when the basal end side thereof is turned downward. More specifically, in a state shown in FIG. 8 in side view (state in which the orientation of the manual paper feeding tray 60 is close to horizontal), the projection 62 is inclined to approach the upper side as the lower surface of the distal end thereof approaches the distal end side, and is configured to a shape the corner on the lower side of the flat plate is scraped off. The basal end side refers to the downstream side in the transporting direction of the tray main body 70, and the distal end side refers to the upstream side in the transporting direction of the tray main body 70.

As illustrated in FIG. 6 and FIG. 7, the two recesses 63 are formed as through-holes at the end surface on the upstream side in the transporting direction of the manual paper feeding guide 74, and the edge of the recess 63 functions as the main body side contacting portion that contacts with the projection 62. The projection 62 is inserted to the recess 63 when the manual paper feeding tray 60 is attached to the jam access cover 61. If the distal end of the manual paper feeding tray 60 is turned downward to more than necessary in this state, the upper surface of the projection 62 contacts with the edge of the recess 63 thereby regulating the turning of the manual paper feeding tray 60. More specifically, the movement of the manual paper feeding tray 60 is regulated so that the distal end of the manual paper feeding tray 60 does not move to the lower side than the tray rotation shaft 73 (see FIG. 4). The recess 63 has the forming position and the size set so that even if the manual paper feeding tray 60 is moved from the housing position (FIG. 2) to the usage position (FIG. 3), the rotation of the manual paper feeding tray 60 is not regulated in such a range.

The positioning of the usage position of the manual paper feeding tray 60 will be described below. As illustrated in FIG. 6 and FIG. 7, the manual paper feeding guide 74 includes positioning ribs 65 of the same shape formed at two areas. The positioning rib 65 is arranged so as to project out from the end surface of the manual paper feeding guide 74, and includes an inclined surface that is spaced away from the end surface of the manual paper feeding guide 74 from the upper side to the lower side. As illustrated in FIG. 7, the end surface on the basal end side of the manual paper feeding tray 60 is received at the inclined surface. At the usage position, the projection 62 and the recess 63 do not contact with each other, and the manual paper feeding tray 60 is held at the usage position by the positioning ribs 65.

A case of turning the jam access cover 61 from the closed position of FIG. 3 to the exposed position of FIG. 4 with the manual paper feeding tray 60 at the usage position as in FIG. 3 will be described below. If the jam access cover 61 is turned from the closed position to the exposed position, the tray rotation shaft 73 moves to separate from the manual paper feeding roller 58 from the position of chain line to the position of broken line of FIG. 8. At the exposed position, the tray rotation shaft 73 is positioned above the jam access cover rotation shaft 72, and on the outer side (right side in FIG. 8) of the main body 78 than the jam access cover rotation shaft 72.

Since the manual paper feeding tray 60 also moves to separate from the main body 78 with the turning of the jam access cover 61, the reception of the manual paper feeding tray 60 by the positioning rib 65 (contact between the positioning rib 65 and the manual paper feeding tray 60) is released. The manual paper feeding tray 60 that has lost the support by the positioning rib 65 and has become rotation free rotates to lower the distal end due to the weight of the distal end side.

However, in the present preferred embodiment, the projection 62 rises in the interior of the recess 63 with the rotation of the manual paper feeding tray 60. Since the projection 62 has a sufficient length, the projection 62 does not completely detach from the recess 63 even if the tray rotation shaft 73 moves and the manual paper feeding tray 60 separates from the main body 78. The movement of the manual paper feeding tray 60 to the lower side is regulated at the point the upper surface of the projection 62 contacts with the edge portion on the upper side of the recess 63 as illustrated in FIG. 8. In other words, as illustrated in FIG. 4, the manual paper feeding tray 60 is regulated in the orientation the distal end side is on the upper side than the tray rotation shaft 73. This prevents the distal end of the manual paper feeding tray 60 from rotating in excess to the lower side.

The manual paper feeding tray 60 that has lost the support by the positioning rib 65 sometimes lowers the distal end with considerable force due to its own weight. However, since a plurality of the projections 62 and the recesses 63 are provided, the impact of a case where the projection 62 and the recess 63 hit each other can be appropriately dispersed even if the force of rotation of the manual paper feeding tray 60 is strong, and hence a configuration excelling in durability can be obtained.

Figure 9:
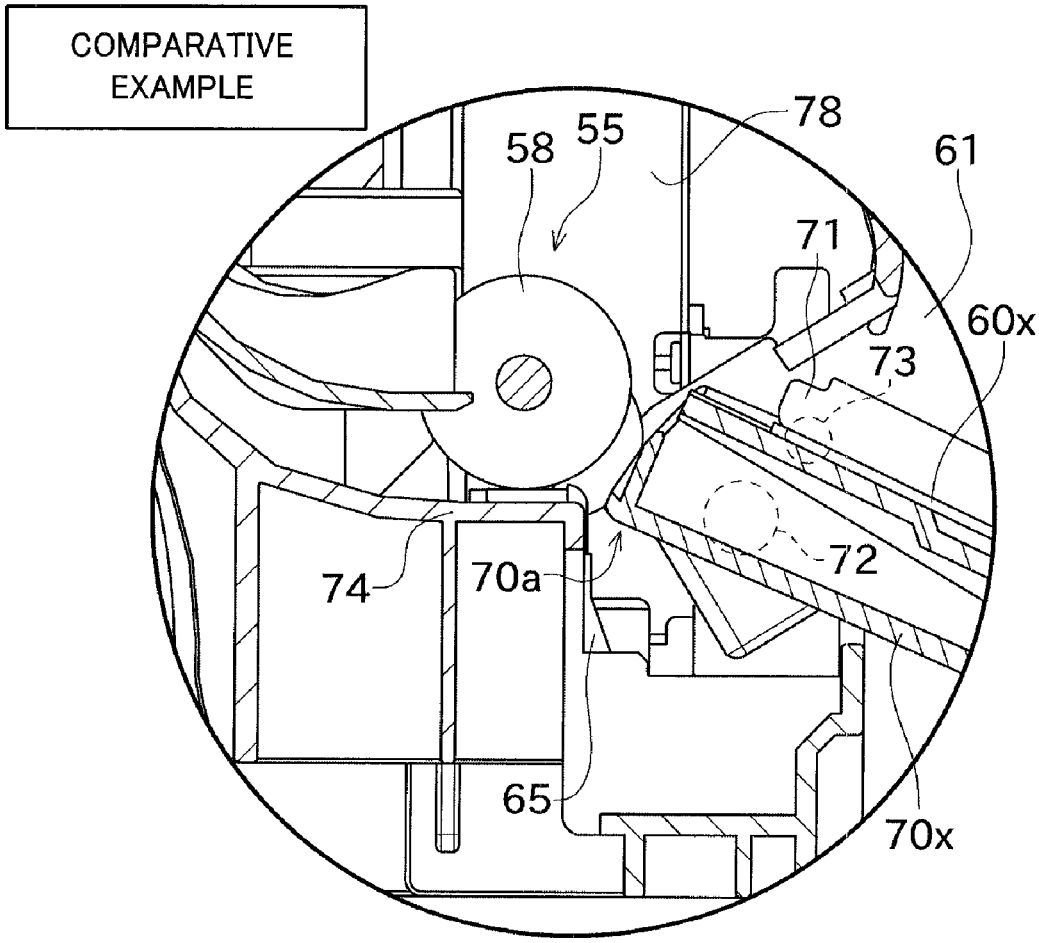
FIG. 9 is an enlarged cross-sectional view illustrating a comparative example in which a rotation regulating mechanism is omitted.

The effects of the configuration will be described in detail below while referencing a comparative example. FIG. 9 illustrates a case where the jam access cover 61 is opened from the closed position to the exposed position with a manual paper feeding tray 60*x* at the usage position, similar to the above, in the manual paper feeding tray 60*x* of a comparative example where the rotation regulating mechanism 64 is omitted.

In the comparative example of FIG. 9, the manual paper feeding tray 60*x* greatly rotates with the opening of the jam access cover 61, and a basal end 70*a* of a tray main body 70*x* faces diagonally upward, as illustrated in FIG. 9, since the regulation on the rotation by the projection 62 and the recess 63 does not work. Therefore, when turning the jam access cover 61 from a state of FIG. 9 (state of excessive rotation) to the closed position, the basal end 70*a* facing upward rides on the upper surface of the manual paper feeding guide 74, and interferes with a component (e.g., manual paper feeding roller 58) on the main body 78 side.

Therefore, the manual paper feeding tray 60*x* and the jam access cover 61 both have to be lifted up and rotated with hands to close the jam access cover 61 from the state of FIG. 9 in the configuration of the comparative example, and thus the operation becomes complicated. When forgetting to lift up the manual paper feeding tray 60*x* from the state of FIG. 9 and closing only the jam access cover 61, the interference may lead to failure. When forcibly moving the jam access cover 61 to the closed position regardless of the interference, excessive force is applied on the jam access cover 61, the manual paper feeding tray 60*x*, and the like, thereby causing breakage.

In this regards, in the present preferred embodiment (FIG. 8), the basal end 70*a* of the tray main body 70 is faced diagonally downward with the projection 62 contacting with the inner wall of the recess 63, and the basal end 70*a* does not further rise, and hence the basal end 70*a* is reliably prevented from riding on the manual paper feeding guide 74. Therefore, the user can lift up only the jam access cover 61 from the state of FIG. 8 (FIG. 4), and easily return to the state of FIG. 7 (FIG. 3). The orientation of the manual paper feeding tray 60 is appropriately regulated (by the positioning rib 65 or the rotation regulating mechanism 64) so that the basal end 70*a* of the manual paper feeding tray 60 does not interfere with other components over the entire opening/closing stroke of the jam access cover 61. Therefore, the user can efficiently perform the open/close task of the jam access cover 61 without being conscious of the position of the manual paper feeding tray 60.

As described above, the multifunction peripheral 75 of the present preferred embodiment is configured as below. In other words, the multifunction peripheral 75 preferably includes the main body 78, the jam access cover 61, the manual paper feeding tray 60, the recess 63, and the projection 62. The main body 78 includes the image forming unit 11. The jam access cover 61 can expose the interior of the main body 78 by being rotated. The manual paper feeding tray 60 is attached to the jam access cover 61 so as to be rotatable with the tray rotation shaft 73 which is different from the jam access cover rotation shaft 72 of the jam access cover 61 as a center. The recess 63 is arranged on the main body 78 side. The projection 62 is arranged on the manual paper feeding tray 60. The projection 62 regulates the rotation of the manual paper feeding tray 60 by contacting with the recess 63 with the jam access cover 61 opened (see FIG. 8).

The excessive rotation of the manual paper feeding tray 60 can be prevented by the projection 62 and the recess 63 even if the jam access cover 61 is opened with the manual paper feeding tray 60 opened, the tray rotation shaft 73 of the manual paper feeding tray 60 moves with the movement of the jam access cover 61, and the manual paper feeding tray 60 is in a freely rotatable state. Therefore, the situation that the excessively rotated manual paper feeding tray 60 is caught and thus the jam access cover 61 cannot be closed is prevented. Since the configuration of regulating the rotation by having the projection 62 on the manual paper feeding tray 60 side contact with the recess 63 arranged on the main body 78 side is adopted, the excessive rotation of the manual paper feeding tray 60 can be reliably prevented regardless of the position of the jam access cover 61. Therefore, breakage that occurs when the manual paper feeding tray 60 contacts with other components can be prevented. The degree of freedom in the arrangement of the manual paper feeding tray 60 can be ensured since the manual paper feeding tray 60 is attached to the jam access cover 61 with the shaft lines of the tray rotation shaft 73 and the jam access cover rotation shaft 72 differed.

In the multifunction peripheral 75 of the present preferred embodiment, the projection 62 is configured to regulate the rotation of the manual paper feeding tray 60 at the position (position of FIG. 4) where the distal end of the paper feeding tray 60 is higher than the tray rotation shaft 73.

The paper 100 is prevented from dropping from the distal end side of the manual paper feeding tray 60 even if the jam access cover 61 is opened with the paper 100 set on the manual paper feeding tray 60 and the tray rotation shaft 73 of the manual paper feeding tray 60 moves.

The multifunction peripheral 75 of the present preferred embodiment preferably includes the positioning rib 65, arranged in the main body 78, to position the usage position (position of FIG. 3) when using the manual paper feeding tray 60.

The manual paper feeding tray 60 thus can be held at a stable and accurate position by the positioning rib 65. The operation of sending the paper 100 set in the manual paper feeding tray 60 to the feeding unit 55 (interior) of the main body 78 thus can be smoothly carried out.

In the multifunction peripheral 75 of the present preferred embodiment, the rotation regulating mechanism 64 preferably includes the projection 62 and the recess 63 corresponding to the projection 62.

A simple configuration capable of reliably regulating the rotation of the manual paper feeding tray 60 thus can be realized.

In the multifunction peripheral 75 of the present preferred embodiment, the projection 62 does not contact with the recess 63, as illustrated in FIG. 7, when the manual paper feeding tray 60 is positioned at the usage position.

Thus, the usage position of the manual paper feeding tray 60 can be more accurately positioned without the projection 62 and the recess 63 getting in the way.

In the multifunction peripheral 75 of the present preferred embodiment, a plurality of the projections 62 are arranged side by side in the width direction of the manual paper feeding tray 60.

Therefore, the impact that occurs when the projections 62 contact with the recess 63 can be dispersed, and the manual paper feeding tray 60 can be stably held at the relevant position after contacting with each other.

The preferred embodiment of the present invention has been described above, but the configuration may be modified as below.

In the above-described preferred embodiment, the tray side contacting portion is preferably configured by two projections 62 and the main body side contacting portion is configured by two recesses 63, but the recess may be formed at the manual paper feeding tray 60, and the projection corresponding thereto may be located at the main body 78.

In the above-described preferred embodiment, the rotation regulating mechanism 64 is preferably configured by two sets of projections 62 and recesses 63, but one or three or more projections and recesses may be arranged. One recess for receiving a plurality of projections may be provided on the main body side. The rotation regulating mechanism thus can be configured without matching the number of recesses with the number of projections.

In the above-described preferred embodiment, a plurality of projections 62 preferably have the same shape, but the shape may be differed for every projection.

The present invention is not limited to the copy-facsimile multifunction peripheral, and may be applied to various image forming devices such as copy, facsimile, and printer.

While the present invention has been described with respect to preferred embodiments thereof, it will be apparent to those skilled in the art that the disclosed invention may be modified in numerous ways and may assume many preferred embodiments other than those specifically set out and described above. Accordingly, the appended claims are intended to cover all modifications of the present invention that fall within the true spirit and scope of the present invention.

What is claimed is:

1. An image forming device comprising:

a main body including an image forming unit;

an open/close cover arranged to expose an interior of the main body by being rotated about a first rotation shaft;

a manual paper feeding tray attached to the open/close cover so as to be rotatable about a second rotation shaft, the second rotation shaft being located at a position different from the first rotation shaft such that the first rotation shaft and the second rotation shaft are not coaxial with one another;

a main body side contacting portion;

a tray side contacting portion, arranged on the manual paper feeding tray, to regulate rotation of the manual paper feeding tray with respect to the main body by being arranged to contact the main body side contacting portion with the open/close cover opened such that the main body side contacting portion limits a range of motion of the manual paper feeding tray with respect to the main body; and a positioning unit, arranged on the main body, to secure a usage position when using the manual paper feeding tray; wherein the manual paper feeding tray is arranged to be opened and closed without moving any portion of the open/close cover;

the tray side contacting portion is arranged to regulate the rotation of the manual paper feeding tray at a position such that a distal end of the manual paper feeding tray becomes higher than the second rotation shaft;

a rotation regulating mechanism including the main body side contacting portion and the tray side contacting portion includes a projection and a recess corresponding to the projection; and the tray side contacting portion does not contact with the main body side contacting portion when the manual paper feeding tray is positioned at the usage position.

2. The image forming device according to claim 1, wherein a plurality of the tray side contacting portions are arranged side by side in a width direction of the manual paper feeding tray.

3. The image forming device according to claim 1, wherein the recess is a through-hole.

4. The image forming device according to claim 1, wherein a feeding unit is arranged above the main body side contacting portion.

* * * * *